United States Patent [19]

Schiavone et al.

[11] 4,346,385

[45] Aug. 24, 1982

[54] MICROWAVE ANTENNA HEIGHT PREDICTION

[75] Inventors: James A. Schiavone, Bridgewater; Arvids Vigants, Red Bank, both of N.J.

[73] Assignee: Bell Telephone Laboratories, Incorporated, Murray Hill, N.J.

[21] Appl. No.: 188,320

[22] Filed: Sep. 18, 1980

[51] Int. Cl.[3] ..... H01Q 19/00; H01Q 9/34

[52] U.S. Cl. ..... 343/703; 343/890

[58] Field of Search ..... 343/890, 703, 844, 853

[56] References Cited

U.S. PATENT DOCUMENTS 3,247,516 4/1966 Rohn et al. ..... 343/890

OTHER PUBLICATIONS

The Bell System Technical Journal, vol. 54, No. 1, pp. 103–142, Jan. 1975.

Bell System Practices, Section 940-310-103, Issue I, Feb. 1973.

National Telecommunications Conference, pp. 16.4.1–16.4.6, Nov. 27–29, 1979.

IEEE Transactions on Antennas and Propagation, vol. AP-16, No. 2, pp. 194–200, 1968.

C.C.I.R. Report 233-3, International Telecommunications Union, XIIIth Plenary Assembly, 1975.

OT Report 75-59, Office of Telecommunications, U.S. Department of Commerce, 1975.

Review of the Electrical Communication Laboratories, vol. 27, pp. 841–848, 1979.

Journal of the Atmospheric Sciences, vol. 34, pp. 1913–1917, 1977.

Monthly Weather Review, pp. 319–339, 1961.

ESSA Technical Report ERL 69-WPL 4, U.S. Department of Commerce, 1968.

*Primary Examiner*—Eli Lieberman

*Attorney, Agent, or Firm*—James H. Fox; Peter V. D. Wilde

[57] ABSTRACT

A model relating obstruction fading to meteorological variables allows more precise prediction of the optimum height of microwave antenna systems. This allows the annual outage time for a circuit to be held to less than a specified maximum value, while at the same time minimizing construction costs by avoiding excessive tower heights. The predictions are especially improved over prior art engineering assumptions in coastal regions.

6 Claims, 4 Drawing Figures

RAY PATHS FOR TWO REFRACTIVTY GRADIENTS

RAY PATHS FOR TWO REFRACTIVTY GRADIENTS

GEOMETRICAL VARIABLES FOR DETERMINING OBSTRUCTION FADE LEVEL

MICROWAVE ANTENNA HEIGHT PREDICTION

BACKGROUND OF THE INVENTION

1. Field of the Invention

This invention relates to the placement of microwave antennas at prescribed heights in order to obtain a probability of transmission outage due to obstruction fading of less than a specified amount.

2. Description of the Prior Art

Microwave radio systems are typically engineered to provide an expected reliability, as measured in a given amount of outage time per year. One component of outage time relates to so-called obstruction fading, wherein objects between microwave antennas temporarily block the transmission of the microwave signal. Microwave signals typically travel in a relatively straight line but are refracted or bent to some degree by the atmosphere. This is caused by a vertical gradient in the index of refraction of the atmosphere, which is affected by such factors as temperature, pressure, and humidity. In a "standard" atmosphere, that is, one that represents average atmospheric conditions, the index of refraction decreases almost linearly with height, causing the upper portion of a wave front to travel at a greater velocity than the portion of the wave front nearer the earth. As a result, the radio wave bends and tends to follow the curvature of the earth. This effectively increases the radio horizon much the same as would result from reducing the curvature of the earth, that is, increasing the radius of the earth. This phenomenon is expressed by an equivalent earth radius factor K, where K equals the effective earth radius divided by true earth radius. In a standard atmosphere, $K=4/3$.

In engineering a microwave system, the antenna heights at each end of a transmission path are selected according to a path profile procedure. In this procedure, a value for the effective earth radius K is assumed, and a graphical representation of surface features is drawn on a hypothetical earth surface having the assumed value of K. A typical path profile chart is shown in FIG. 1. Note that the horizontal and vertical scales are unequal. The terrain between sites A and B includes natural obstructions man-made obstructions, and the highest point of seasonal obstructions (for example, the highest expected growth of trees between sites A and B, as indicated by vertical arrows). In order to obtain successful propagation of a microwave signal between sites A and B, the microwave beam must clear all the obstructions. The amount of clearance between the beam and any obstruction is typically measured in terms of Fresnel zones. Considering FIG. 1, the first Fresnel zone is defined as the locus of points defining a path between points A and B by which an electromagnetic wave of a given wavelength $\lambda$ is delayed by one-half wavelength, as compared to a wave traversing the line of site path 11 between points A and B. Thus, paths $F_1$ define the first Fresnel zone in FIG. 1. Similarly, the boundary of the $n^{th}$ Fresnel zone consists of all points from which the delay is n/2 wavelengths.

The amount of Fresnel zone clearance and the value of K is typically based on the results of past experience on microwave paths in various geographical regions. The clearance rules used in the Bell Telephone System, which are frequently taken as the standard for the industry, are briefly described in "Space Diversity Engineering" by A. Vigants in the *Bell System Technical Journal,* Vol. 54, No. 1, pages 103–142 (1975). The propagation conditions in the 48 contiguous United States are summarized according to FIG. 21 therein, which divides the country into good, difficult, and average propagation regions. The rules for utilizing that information provide that in those areas of the country having good propagation conditions, the obstruction clearance should be at least 0.6 of the first Fresnel zone at $K=1$, but not less than grazing at $K=\frac{2}{3}$. In those areas having average propagation conditions, the clearance rule is the larger of 0.3 of the first Fresnel zone at $K=\frac{2}{3}$, and the first Fresnel zone at $K=4/3$. In those areas having difficult propagation conditions, the rule is that clearance is greater than grazing at $K=\frac{1}{2}$.

Such empirical judgements based upon a history of microwave propagation at a number of sites throughout the United States have been very useful. However, that method lacks a precision that is desired in present-day engineering of microwave radio routes that include digital data and other services. Down time, including that due to obstruction fading, is required to be less than a certain amount per year. On the other hand, the high cost of supporting structures for microwave antennas makes it desirable to minimize the overall heights of the towers in a given microwave system. In particular, when a microwave system comprises more than one path, it is desirable to design each path within the system so as to contribute a specified amount to the overall outage time of the system. This helps avoid unnecessary construction costs for providing a desired overall path reliability.

Numerous prior art studies have determined the value of K for given microwave paths. However, such studies are expensive and time-consuming, especially when it is desired to engineer an entire system. Other prior art studies have related certain climatological variables to certain propagation conditions. However, none has related readily available climatological conditions available for a given site to the value of K that should be chosen to achieve a given outage time. It would be desirable, therefore, to have improved methods by which climatological information can be utilized in designing microwave transmission facilities in order to obtain a given degree of reliability while minimizing antenna tower heights.

SUMMARY OF THE INVENTION

We have invented a method of determining the heights of the antennas at each end of a microwave transmission path to provide for a given degree of transmission reliability due to obstruction fading. The heights of the antennas above ground are chosen by a path profile procedure which is related to the vertical gradient of refractivity of the atmosphere in the vicinity of the path, N'. The value of N' is chosen to produce the expected outage time consistent with the path reliability desired according to a specified probability density function based on climatological and physiographical data. This density function is the weighted sum of two Gaussian probability density functions representing the daytime (mixed atmosphere) and nighttime (stratified atmosphere) regimes. The weighting factor, the mean, and the standard deviation of these density functions are empirically determined parameters. The density functions are typically averaged over several subdivisions of a year, most typically once per season. In addition to this meteorological model, the degree of obstruction fading due to partial blockage of the transmitted ray can be estimated on the basis of the distance of the virtual ray to the controlling obstruction, according to a specified formula.

DETAILED DESCRIPTION

The following detailed description relates to a method of determining the heights of microwave antennas in order to achieve a desired transmission reliability.

The present invention provides a climatological model to predict quantitatively the geographical variation of the occurrence frequency of positive refractivity gradients within the United States. This model is based upon climatological and physiographical data available for the microwave sites. The results can be used to estimate obstruction fading occurrence on microwave radio paths to help determine optimum microwave antenna heights. The result of this model is a predicted positive refractivity gradient cumulative probability distribution for an arbitrary location within the United States for arbitrarily large positive gradients. In addition, the amount of clearance required to maintain an acceptable fade level is determined by the use of an empirically determined obstruction fading formula.

When predictions of the climatological model are compared to measured distributions, they in general show good agreement. Imperfect agreement that exists in a few cases is attributed to local effects which cannot be accounted for without introducing additional complexity with attendant risk of making the model unwieldly to implement. That is, a geographical resolution is employed for the model which has been judged optimum by weighing resolution improvements against simplicity of model use.

The climatological model is formulated in two stages. First, parameters are chosen based on meteorological principles, to relate the occurrence frequency and magnitude of refractivity gradients to available climatological and physiographical data. Second, a method for producing a refractivity gradient probability distribution from these parameters is developed. The model is quantified by comparison with measured distributions. Final minor adjustments are made to the model to provide consistency with information on the geographical distribution of obstruction fading gleaned from transmission performance experience.

REFRACTIVITY GRADIENT

The refractive index, n, for microwaves can be expressed as refractivity $$N=10^6(n-1)=77.6/T\,[P_r+4810e/T] \quad (1)$$

where N is the refractivity in N-units, T is the air temperature in degrees Kelvin, $P_r$ is the air pressure in millibars, and e is the water vapor pressure in millibars. The vertical gradient of N is designated N′, and is expressed in N-units per kilometer. The relationship between the equivalent earth radius factor K, and N′ is given by the standard formula $$K=1/(1+N'/157). \quad (2)$$

Figure 1:
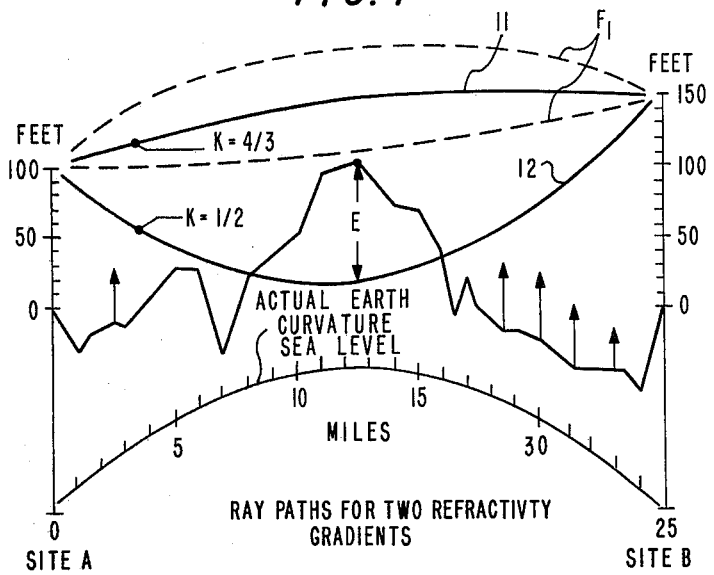
FIG. 1 shows a typical path profile plot and a first Fresnel zone.

When N′ becomes large, the value of K becomes small. That is, the effective radius of the earth becomes small, indicating that the microwave signal is not "bent" to follow the earth's curvature as much. As shown in FIG. 1, a microwave signal that clears all obstructions in a standard (K=4/3) atmosphere may be blocked by an obstruction for a smaller value of K, as shown for $K=\frac{1}{2}$. Water vapor pressure is the governing contributor to production of positive refractivity gradients (N′) at night. Therefore, a positive refractivity gradient model must predict climatologically the frequency of occurrence of positive e-gradients. As used herein, the term "positive refractivity gradient" means the refractivity gradient has a value greater than or equal to $\mu$, the mean value of the refractivity gradient. However, in some cases, the "positive refractivity gradient" may in fact be a negative number.

METEOROLOGY

During obstruction fading, the important part of the microwave beam generally lies within the lowest 100 m of the atmosphere. Furthermore, a height increment of 100 meters has been used frequently in meteorological measurements. Therefore, this model is designed to predict gradients in the lowest 100 m. Simple recalibration of the 100-meter measurements allows predictions to be made for other increments. For example, we have found that a height increment of 45 meters provides for more accurate quantitative prediction of obstruction fading for path lengths of approximately 20 to 30 miles.

Several mechanisms can produce inverted (positive gradient) water vapor vertical profiles. In the present model, large-scale advection of moist air is utilized as the mechanism for production of most of the obstruction fading on line-of-sight microwave radio routes.

An understanding of the details of the proposed large-scale moisture advection mechanism requires knowledge of atmospheric motion on various distance scales. Atmospheric motion within the boundary layer, across the continent, and within air masses will now be discussed separately.

Obstruction fading usually occurs during fine weather conditions, when anticyclonic air masses envelop the affected region. Thus, the characteristics of the boundary layer and their diurnal variation only in fine weather conditions need be considered.

During the day solar radiation causes convective mixing which produces a relatively deep (>~1 km) boundary layer which is vertically well mixed throughout. Thus, vertical gradients of water vapor and horizontal momentum are relatively small across the lowest 200 m where the microwave beam lies. Small vertical gradients of horizontal momentum produce small wind speed and direction gradients.

At night, radiative cooling of the earth's surface produces a relatively thin (~100 m) density-stable boundary layer. The high stability suppresses turbulence and very little vertical mixing occurs; water vapor inversions would be maintained once produced. Relatively large wind speed and direction gradients could be maintained across the boundary layer because of the limited vertical mixing of horizontal momentum. Calm winds often occurs at the surface.

Large-scale air motion is determined by the mid-tropospheric (~7 km) winds. These currents steer air masses across the North American continent, in general, from west to east. Air masses that affect the United States usually originate over northwest Canada or the eastern Pacific Ocean. Pacific air masses crossing the continental divide lose much of their moisture through lifting-induced precipitation over the western mountains. Thus, except for the west coast, air masses are relatively dry until they reach the Great Lakes, Atlantic Ocean, or Gulf of Mexico. Once they reach these large water bodies, evaporation increases their moisture content.

Air flow at moderately low levels (<~2 km) within anticyclonic air masses is essentially circular (for the purpose of this discussion) with respect to the air mass core, and in a clockwise direction. Thus, moderately low level winds at a given location change direction as an air mass traverses the region. Furthermore, winds near the center of the air mass are very light because of small horizontal pressure gradients, and are therefore conducive to formation of highly stratified air layers there.

The mechanism for production of water vapor inversions by large-scale moisture advection that is utilized in the present technique is as follows: dry air masses approach the east (south) coast of the United States from the west (northwest). Before the air masses reach the coasts, moderately low level (<~2 km) wind flow is mainly offshore in coastal regions, thus maintaining dry air there. As the air mass core comes sufficiently close to the coast, winds to the south and west of the air mass core shift to an onshore direction, advecting moist air inland. If the offshore-onshore wind shift occurs near sunset, the characteristics of the nocturnal boundary layer discussed earlier, wind speed and direction differences across it, cause moist air to be advected over the top of surface-based dry air. The differential wind speed advects moist air inland faster at ~200 m than at the surface. The differential wind direction, which is normally a clockwise shift with height, also contributes to maintaining faster inland penetration of moist air at ~200 m relative to the surface.

Production of positive e-gradients at a particular site requires that the site be sufficiently close to a moisture source so that most air could reach the site during the nocturnal stratified air regime. Measured refractivity gradient distributions show that elevated moist layers occur most frequently near large bodies of water such as oceans, gulfs, and large lakes. However, measurements show also that elevated moist layers occur at sites too far from these large water bodies to have had them for their source of moisture. Thus, mechanisms other than large-scale advection probably also contribute to positive refractivity gradients. It is not possible to model each mechanism specifically as can be done for large-scale moisture advection. Therefore a large-scale-moisture-advection model is employed near large water bodies (coastal regions) while a mechanism-independent model is employed for other areas (interior regions).

COASTAL REGION

The model is parameterized by six factors relating the occurrence of positive e-gradients to parameters obtainable from seasonal climatological and physiographical maps. The factors are: temperature inversion occurrence frequency, $f_i$, air homogeneity, H, water body proximity, D, wind direction occurrence frequency, $f_w$, air moisture capacity, V, and surface moisture availability, M. The proportionality among the six factors and their individual normalization is obtained empirically from measured N′ probability distributions. The factors $f_i$ and H specify the occurrence of stratified air, while D and $f_w$ specify the magnitude of the positive e-gradients.

The occurrence of stratified air in the lowest 100 m coincides with the existence of temperature inversions (temperature increase with height). Hosler has compiled maps of the occurrence frequency of surface-based temperature inversions for 4 seasons within the United States; see C. R. Hosler, "Low-Level Inversion Frequency in the Contiguous United States", *Monthly Weather Rev.*, Vol. 89 (September 1961), pp. 319–339. The temperature inversion occurrence frequency, $f_i$, whose units represent the fraction of total time that inversions occur for a given location and season, is employed as a factor in the coastal model.

For obstruction fading to occur, large positive e-gradients must occur over the entire microwave path. Thus, the horizontal homogeneity of the stratified air, which is determined by the flatness of the terrain profile, must be large for the occurrence of obstruction fading. Therefore a factor, H, is introduced which represents the horizontal homogeneity of the stratified air. Values for this factor are obtained from a map in "Classes of Land Surfaces Forms", *The National Atlas of the United States of America,* U.S. Department of the Interior Geological Survey, plate 62, 1970. In this map, each location is represented by 3 characteristics: slope, local relief, and profile type. In the present model, each characteristic is defined as a subfactor of H $$H=H_1H_2H_3. \tag{3}$$

Numerical values of $H_1$, $H_2$, and $H_3$ have been acquired by comparison of the model with the geographical distribution of microwave transmission performance in the Bell System. Transmission performance experience is employed since it represents the only existing path-averaged obstruction fading information. Values obtained for $H_1$, $H_2$, and $H_3$ are provided in Table I, below.

TABLE I

| Air Homogeneity Subfactors | | | | | |
|---|---|---|---|---|---|
| Slope Class | $H_1$ | Relief Class | $H_2$ | Profile Class | $H_3$ |
| A | 1.0 | 1 | 1.0 | a | 0.7 |
| B | 1.0 | 2 | 0.9 | b | 0.8 |
| C | 0.8 | 3 | 0.5 | c | 0.8 |
| D | 0.4 | 4 | 0.5 | d | 1.0 |
| | | 5 | 0.5 | None | 1.0 |
| | | 6 | 0.5 | | |

For the coastal region, production of positive e-gradients requires proximity to a large water body. There is a maximum distance inland that moist air originating at the coastline at sunset could penetrate during the nocturnal stratified air regime. Therefore, a smoothed-step distance function is used herein to represent this effect:

$$D=[1+(d/d_o)^4]^{-1} \tag{4}$$

where d is the minimum distance in km to an ocean, gulf, or one of the Great Lakes, and $d_o=300$ km, as determined by the maximum distance inland that the air penetrates in a period of one day, as typically determined by its motion during 12 hours when moving at an average speed at ~100 m height. It has been found in the case of west Texas that the Rio Grande River Valley is an effective "coastline". Narrow zones of large horizontal moisture gradients ("drylines") are often observed oriented roughly north-south through west Texas and Oklahoma. For this reason the location at which the Rio Grande River turns westward from colinearity with the Odessa region is employed as an effective distance to a water source, and is included herein. Incorporation of this special treatment results in a prediction consistent with transmission performance records.

For every location there is a wind direction that will maximize the relative advection of moist air over dry air. The appropriate direction will vary with distance to, and shape of, the coastline nearest the site. The procedure for specifying this direction for different sites is discussed in Appendix A. The production of positive e-gradients is proportional to the frequency, $f_w$, that wind blows along this direction. Values for $f_w$, in units of fraction of total time, are obtained from surface wind direction frequency distributions; see *Weather Atlas of The United States,* Detroit: Gale Research, pp. 237, 240, 243, 246, June, 1968.

The magnitude of the e-gradients formed will depend upon the water vapor capacity of the air. The water vapor capacity, in turn, depends upon air temperature, T. The saturation vapor pressure function, $e_s(T)$, is chosen herein to represent the dependence of water vapor capacity on air temperature. The water vapor capacity factor used herein is represented by:

$$V=e_s(T)/e_{so} \tag{5}$$

where $e_s(T)$ is in millibars, and $e_{so}=50$ millibars, an approximate upper limit for naturally occurring vapor pressures. The function $e_s(T)$ can be represented by $$e_s(T)=\exp[21.71-5433/T] \tag{6}$$

where T is in degrees Kelvin. Temperatures employed are those obtained from monthly average temperature maps of the United States; see *Weather Atlas of the United States* (above) at pp. 4, 19, 34, 49.

The magnitude of the e-gradients produced by advection from large water bodies will be reduced if substantial smaller local sources of water exist at the site. This is caused by evaporation of surface water into the dry lowest air layer. This effect is modeled with a surface moisture factor:

$$M_C=m_1/(m_o+m) \tag{7}$$

where m is a surface moisture index obtained from a map of moisture regions; see C. W. Thornthwaite, "An Approach Toward a Rational Classification of Climate", *Geographical Rev.,* Vol. 38 (1948), pp. 55–94. In addition $m_o=70$ and $m_1=20$ is obtained by comparison with measured N′ distributions. The subscript C denotes the coastal region since a different moisture factor is employed for the interior region.

In summary, the 6 factors used for determination of the occurrence of positive e-gradients in the coastal region are $f_i$, H, D, $f_w$, V, and $M_C$.

INTERIOR REGION

The model for interior sites is a modification of that developed for the coastal sites. The 2 factors representing the production of stratified air layers, H and $f_i$, are the same as for the coastal model. However, the 2 factors representing the production of positive e-gradients, D and $f_w$, are combined into a single constant factor, a, wherein $a=Df_w$. This is required because it is not feasible to take into account the variety of mechanisms thought to contribute to gradient production in interior regions. Determination of a is discussed below. Finally, of the 2 factors representing the magnitude of the e-gradient produced, V and M, only M need be modified. This modification is required since the surface moisture index, m, provides the necessary information regarding the availability of moisture from local sources. Thus, the proportionality between M and m is inverted with respect to the coastal site model. The interior region model for M is:

$$M_I=m+m_2 \tag{8}$$

It is determined empirically that $a=4.7\times10^{-5}$ and $m_2=100$; see Appendix B.

The 5 factors used for determination of the occurrence of positive e-gradients in the interior region are $f_i$, H, a, V, and $M_I$.

The interior model, instead of the coastal model, is applied to the Pacific Coast of the United States. The large-scale moisture advection mechanism upon which the coastal model is based is not valid for the Pacific Coast since air masses cross the coast already containing much moisture. Furthermore, relatively high coastal mountain ranges prevent low level nocturnal differential advection.

REFRACTIVITY GRADIENT PROBABILITY DISTRIBUTION

A mixture of two probability density functions is employed to calculate the total probability density of N′. These component functions are given by the Gaussian probability density functions:

$$p_m(N')=(2\pi\sigma_m^2)^{-\frac{1}{2}}\exp\left[-\tfrac{1}{2}\left(\frac{N'-\mu}{\sigma_m}\right)^2\right] \tag{9}$$

$$p_s(N')=(2\pi\sigma_s^2)^{-\frac{1}{2}}\exp\left[-\tfrac{1}{2}\left(\frac{N'-\mu}{\sigma_s}\right)^2\right] \tag{10}$$

where m and s denote the mixed and stratified regimes, respectively. These formulae are valid for $N'\geqq\mu$; i.e., the positive refractivity gradient regime. The total probability density function is given by:

$$p(N')=(1-p^*)p_m+p^*p_s \tag{11}$$

where p* is the proportion of mixture for the two component densities. The total probability density function is hence a weighted sum of the two component density functions, with p* being the weighting factor.

Empirical comparison of a mixture of two distributions with Samson's U.S. data was made, and it was determined that $p^*=0.2$ and $\sigma_m=15$ N-units/km and that both were essentially invariant with respect to location and season ("Refractivity Gradients in the Northern Hemisphere", C. A. Samson, *OT Report,* 75–59, April 1975). The total probability density function is an average obtained over one or more subdivisions of a year and hence can be represented as:

$$p(N') = \frac{1}{n} \sum_{\alpha=1}^{n} (1 - p^*) p_m^{\alpha} + p^* p_s^{\alpha} \quad (12)$$

Typically, n=4, corresponding to the 4 seasons, with data for a month being used to represent a season when monthly data is available. In some cases, depending on variability of the parameters, a single yearly value, or biannual average, or monthly average, etc., corresponding to n=1, 2, or 12, respectively, may be used. Bean et al. (*A World Atlas of Atmospheric Radio Refractivity*, ESSA Monograph 1, U.S. Govt. Print. Off., Washington (1966), pp. 53–58) have compiled seasonal maps of the average refractivity gradient in the lowest kilometer. This data is used to specify $\mu$ as a function of location.

The standard deviation for the stratified regime, $\sigma_s$, is parameterized separately for the coastal and interior regions:

$$\sigma_{sC} = \sigma_o (f_i H)^{\frac{1}{2}} (D f_w V M_C)^{\frac{1}{4}} \quad (13)$$

$$\sigma_{sI} = \sigma_o (f_i H)^{\frac{1}{2}} (a V M_I)^{\frac{1}{4}} \quad (14)$$

Both are calculated for each site and season and the larger of the two is employed to calculate $p_s$ for each season. Total probability density, p(N'), is calculated for each season, and the seasonal probabilities are averaged to produce an annual probability density function for each site. Finally, the annual probability density function is integrated from N' to positive infinity in order to produce the probability distribution function for N'. A given value of this distribution function is designated $P(N_o')$, wherein $P(N_o')$ represents the probability that the value of N' exceeds $N_o'$; alternately designated, $P(N_o') = P(N' > N_o')$.

It is determined empirically from Samson's 17 measured N' distributions that $\sigma_o$ for a 100 m height increment is 440 N-units/km. N' distributions have been compiled at several sites for height increments ($\Delta z$) different from 100 m. Samson (above) has compiled annual distributions at Cardington, England for 75, 150, and 500 m thick layers. Dougherty "A Survey of Microwave Fading Mechanisms, Remedies, and Applications", *ESSA Technical Report* ERL 69-WPL 4, (1968) compiled annual distributions at Cocoa Beach, Florida for 50 and 100 m thick layers. Values for the climate parameters appropriate to each site were employed in an empirical determination of $\sigma_o$ for the 5 available layer thicknesses. H=1 was employed in this determination of $\sigma_o$, as the present model represents path averages, whereas the above-measured distributions are compiled at single points.

The results provide the relationship $$\sigma_o(\Delta z) = 1400/\Delta z^{\frac{1}{2}} \quad (15)$$

where $\Delta z$ is in meters, and $\sigma_o$ is in N-units/km. Thus, $\sigma_o$ for an arbitrary height increment can be obtained from this equation. It has been determined that for microwave radio paths having lengths of about 20–30 miles, that $\sigma_o = 540$, corresponding to a height increment of 45 meters, provides for more accurate quantitative prediction of obstruction fading than does a height increment of 100 meters.

PARAMETER SUMMARY

Complete specification of a predicted N' probability distribution is made by the parameters p*, $\mu$, $\sigma_m$ and $\sigma_s$. The parameters p* and $\sigma_m$ are constants; however, $\mu$ and $\sigma_s$ must be specified for each season as a function of location. Bean et al. (above) provide seasonal maps for $\mu$ measurements, and specification of $\sigma_s$ is summarized in Table II.

TABLE II

Summary of Method for Evaluating $\sigma_s$ Parameters

| Parameter Calculation | Equation Constants | Climatological Variables |
|---|---|---|
| $f_i$ | — | $f_i$ |
| H (Eqn. 3) | Table I | Terrain Classes |
| D (Eqn. 4) | $d_o$ = 300 km | d |
| $f_w$ | — | $f_w$ |
| V (Eqn. 5) | $e_{so}$ = 50 mb | T |
| $M_C$ (Eqn. 7) | $m_o$ = 70, $m_1$ = 20 | m |
| a | a = 4.7 × $10^{-5}$ | — |
| $M_I$ (Eqn. 8) | $m_2$ = 100 | m |

OBSTRUCTION FADING

The decrease of received signal power caused by blockage of the ray path between the antennas is referred to as obstruction fading. It is described in terms of fade time during which the received signal is below an allowable fade level. The "allowable" fade level is determined by the maximum path loss which can be tolerated by the system while still maintaining satisfactory communications. It is thus a system parameter related to antenna gain, transmitter power output, receiver sensitivity, etc., calculated for a particular system according to principles known in the microwave art. A typical microwave system is engineered so that the allowable fade level for obstruction fading is approximately 35 db below the daytime non-fade signal level. The annual obstruction fade time for a microwave radio path can therefore be expressed, in seconds per year, as:

$$T_h = T_O P(N' > S) \quad (16)$$

where $T_O$ is the number of seconds in a year, and where S is the value of N' which results in fading to the allowable fade level for a given path.

The fade level is a function of the vertical distance from the top of the controlling obstruction to the virtual ray. This distance is described by E, which is measured in feet in the example in FIG. 2. In the case of tree-covered terrain, the maturity height of trees is part of E. For deep obstruction fading, we have found that the fade level in db relative to the "free-space" level is:

$$R = -10 + 20E/E_{1r} \quad (17)$$

where, to signify blockage of transmission, the value of E is negative. The quantity $F_{1r}$ is the radius of the first Fresnel zone (in feet) at the controlling obstruction:

$$F_{1r} = 72.1(L_1 L_2 / fL)^{\frac{1}{2}} \quad (18)$$

where f is the radio frequency in GHz, L is the path length in miles, and $L_1$ and $L_2$ are the distances from the controlling obstruction to the ends of the path, also expressed in miles. Of course other units can be employed with appropriate change of the constant. The controlling obstruction is one for which the dimensionless clearance $E/F_{1r}$ has the greatest negative value.

Figure 3:
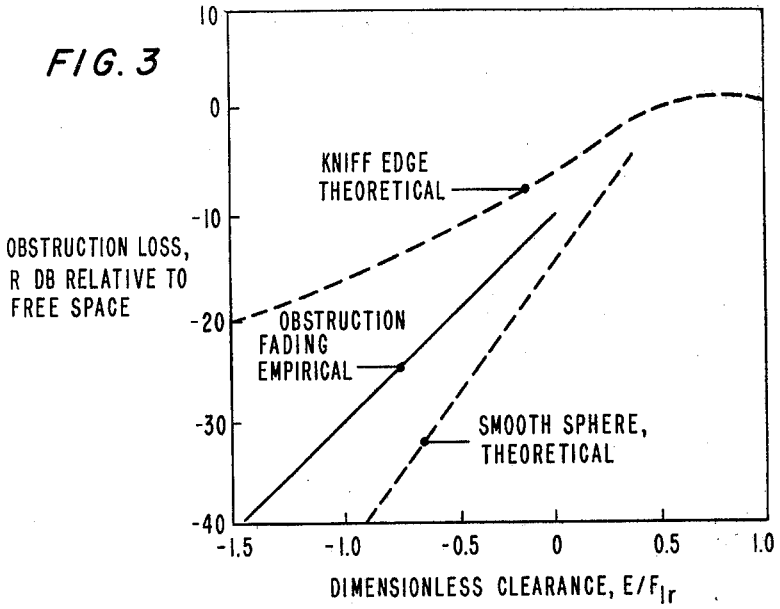
FIG. 3 shows obstruction fade as a function of clearance.

The obstruction loss curve described by R in the equation above is located between the curves for diffraction by a knife edge and by a smooth sphere, as illustrated in FIG. 3. This curve is based on experimental data, and it reflects the fact that, in the equivalent earth formulation, the path profile becomes more wedge-like as the values of K become smaller for deep obstruction fades. This wedge-like accentuation of the central portion of the path permits application of the above loss curve to most paths between 20 and 30 miles in length at frequencies between 2 and 11 GHz, with greater ranges for these values being possible. Knife edge paths (single and multiple) are an exception, but these usually occur in mountainous terrain where obstruction fading is not a problem.

APPLICATION OF MODEL

To determine the obstruction fade time $T_h$ at a particular fade level, the equation for the obstruction loss R is inverted to obtain a value of the vertical distance E. (The value of R is chosen so as to represent the allowable fade level.) The refractivity gradient S that corresponds to this value of E is determined by the antenna centerline heights and the geometry of the path (Appendix C). With S determined, the fade time $T_h$ is obtained from the probability that the refractivity gradient exceeds S. Therefore, by an iterative procedure, the antenna heights can be adjusted to provide for the desired transmission reliability, which can be expressed as $T_h$, the fade time per year. Alternatively, the transmission reliability can be specified, and the above equations inverted, in order to specify the required value of N', and hence K, which achieves the desired reliability. Given this value of K, the antenna heights are then determined by standard path profile procedures. In engineering a multiple path facility, the reliability of each of the paths need not be equal. Rather, the expected annual outage time can be allocatd to the individual paths to minimize total construction costs, or to provide for a given reliability of a given path, while still maintaining the total expected outage time of the facility.

While the above meteorological model has been found to accurately predict fade time when used with the obstruction fade equation (17), the model is believed also applicable to other types of obstruction loss curves. Furthermore, future empirical measurements may result in a refinement in the various parameters used to specify the annual probability density function for N'. All such deviations and variations are considered to be within the spirit and scope of the present invention.

APPENDIX A

Critical Wind Direction Choice

There is no climatological information on the occurrence frequency of wind shifts from continental to maritime directions as air masses traverse the coastlines. However, there is a certain wind direction relative to a coastline which is related to the occurrence of large-scale moisture advection.

Before air masses reach the coasts, moderately low level air flow is roughly parallel to the coast with land to the right of the wind vector. Furthermore, this direction is conductive to production of moisture gradients by the mechanism of wind direction variation with height, as discussed above. Therefore, the surface wind direction that will most likely cause flow of marine air over continental air adjacent to the coastline is the direction that will most likely cause flow of marine air over continental air adjacent to the coastline is the direction parallel to the coast with land to the right of the wind vector. This is the critical wind direction at the coastline for an ideal linear coastline of infinite extent. In reality, however, the critical direction choice must account for the curvature of the coastline. This is required to ensure that air assumed to be continental (maritime) in origin indeed is underlain by land (water) for a significant distance upwind from the site. An appropriate choice of minimum distance is the distance traveled by air in one day at average speed, ~300 km.

Figure 4:
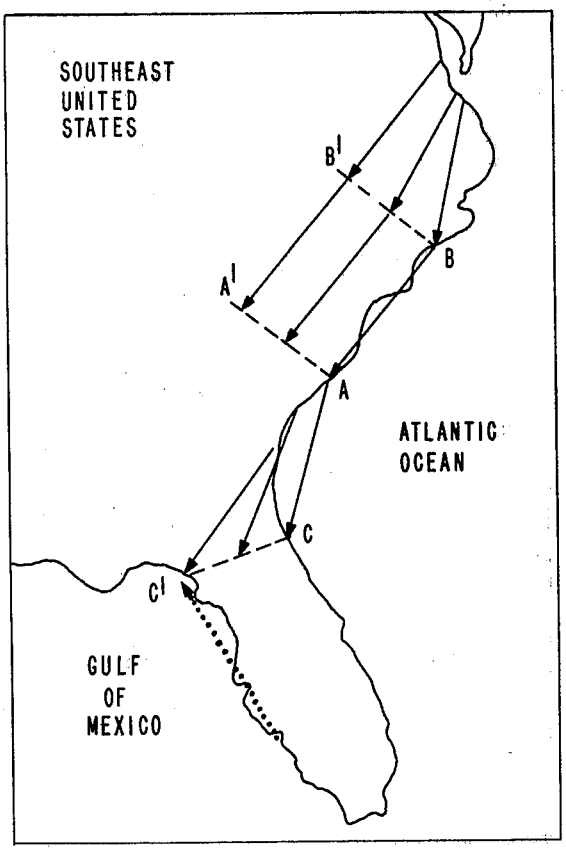
FIG. 4 shows the technique used for determining the critical wind direction.

Because of unavoidable subjectivity required in selecting critical wind directions for some sites, the selection technique is best illustrated with examples. FIG. 4 shows 9 sites along the southeast U.S. coast, 3 each along lines drawn perpendicular to the Atlantic Ocean coast from 3 different coastal sites: A, B, and C. Critical directions for line AA' are parallel to the coast because land lies upwind along this vector for a distance of at least 300 km. This assures that air arriving at sites along line AA' is indeed continental. Such an assurance is not obtained for sites along line BB' if the critical directions are chosen parallel to the coast at B. The directions are chosen so that there is a distance of 300 km flow over land upwind from sites along BB', as shown in FIG. 4.

The situation at site C is complementary to that at site B. Here the critical wind direction is chosen so that the wind vector is underlain by water for a distance of 300 km upwind from site C. The critical direction at the other 2 sites along CC' is chosen assuming that maritime air has its source over the Atlantic Ocean rather than the Gulf of Mexico. This is done since a gulf source would require a critical direction at site C', e.g., as shown by the dotted arrow in FIG. 4. This direction, in turn, would imply continental air originating in the southern half of the Florida peninsula. Obviously, this cannot be considered a source of dry, continental air. Critical direction choices illustrated in the above examples are typical of those made in the United States.

APPENDIX B

Empirical Determination of a and $m_2$

The values of a and $m_2$ for the interior regions are obtained by comparison with measured refractivity gradient probability distributions for Columbia, Mo. Values are obtained for $\mu$, $f_i$, V, and m for Columbia. H=1 is employed for comparison of the model with point gradient measurements. The value for $\sigma_o$ obtained for coastal regions is employed. From Eqn. (14), $\sigma_{sI}$ for Columbia is given by $\sigma_{sI}$=constant X $a(30+m_2)$ where the constant is evaluated from the above values.

Determination of the optimum agreement between calculated N' distributions (using $\sigma_{sI}$ as specified above) and the measured N' distribution for Columbia yields a relationship between a and $m_2$. The remaining variable is determined by subjecting calculated values of $\sigma_{sI}(m)$ to constraints for the possible range of m: $-50 \leqq m \leqq 120$. Columbia's surface moisture index of 30 is intermediate within this range. A second point to completely specify a and $m_2$ is obtained by assuming that $\sigma_{sI}(m=120)$ for Columbia is equal to the smallest value of $\sigma_{sC}(m=120)$ calculated for all of the 14 noninterior sites. Thus, it is determined that $a=4.7\times10^{-5}$, and $m_2=100$.

APPENDIX C

Path Geometry and Refractivity Gradient

In engineering practice, drawings of terrain profiles are constructed to obtain a ray path that is a straight line for a particular value of the earth radius factor K. This is achieved by a modification of the shape of the sea level, described by a "bulge height"

$$h=L_1L_2/1.5K$$

where h is in feet when $L_1$ and $L_2$ are in miles. This is illustrated in FIG. 2, where the profile from FIG. 1 is redrawn for $K=\frac{1}{2}$.

Figure 2:
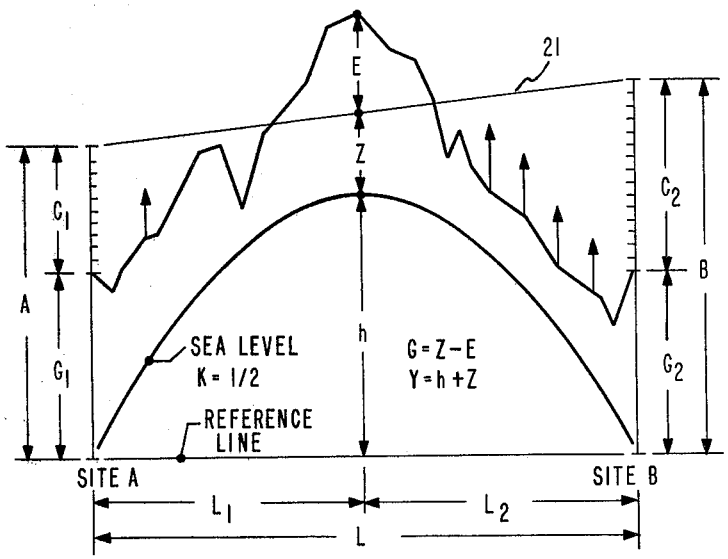
FIG. 2 shows various geometrical variables used in estimating obstruction fade level.

The variables used to relate the vertical distance E to a value of the refractivity gradient are summarized and defined in FIG. 2. The ground elevations of the radio stations and the antenna centerline heights determine the variables A and B. The height of the virtual ray at the controlling obstruction is $Y=h+Z$, which is relative to the reference line, and can be determined by:

$$Y=A+(B-A)(L_1/L)$$

The relationship of the vertical distances at the controlling obstruction is:

$$Y-E=h+G,$$

where G is the elevation of the top of the obstruction (i.e., $G=Z-E$). The minus sign arises because E has a negative value when the ray path is blocked. When the virtual ray is above the controlling obstruction, E has a positive value. For tree-covered terrain, tree heights are included in both E and G.

The equation above is used to determine h when E is specified, as from Eqn. (17). The bulge height equation at the beginning of this appendix is then used to determine K, which in turn determines the value of the refractivity gradient (Eqn. 2). This value of the refractivity gradient is designated S.

We claim:

1. A microwave transmission facility comprising at least two antennas at opposite ends of a transmission path, wherein the heights of said antennas above ground are chosen by a path profile procedure wherein an effective earth radius is utilized having a ratio to the actual earth radius of K, wherein K is determined from N', the vertical gradient of refractivity of the atmosphere in the vicinity of said path, characterized in that said transmission facility is designed to provide a probability of outage due to obstruction fading of less than a given amount, wherein the value of N' is chosen to produce said probability of outage according to the weighted sum of probability density functions comprising a first density function characteristic of the mixed atmosphere of the daytime regime, and a second density function characteristic of the stratified atmosphere of the nighttime regime, wherein the standard deviation of said second function is the larger of those characteristic of a coastal region and an interior region, with the extent of the coastal region being determined by factors comprising the distance that air penetrates inland in a period of one day from an ocean, gulf, or one of the Great Lakes, and wherein the standard deviations characteristic of said interior region and said coastal regions are determined by factors comprising: (1) temperature inversion occurrence frequency; (2) air homogeneity; (3) water body proximity; (4) wind direction occurrence frequency; (5) air moisture capacity; and (6) surface moisture availability.

2. A microwave transmission facility comprising at least two antennas at opposite ends of a transmission path, wherein the heights of said antennas above ground are chosen by a path profile procedure wherein an effective earth radius is utilized having a ratio to the actual earth radius of K, as determined by the formula $$K=1/(1+N'/157)$$

wherein N' is the vertical gradient of refractivity of the atmosphere in the vicinity of said path, characterized in that said transmission facility is designed to provide a probability of outage due to obstruction fading of less than a given amount, wherein the value of N' is chosen to produce said probability of outage according to the probability density function:

$$p(N') = \frac{1}{n}\sum_{\alpha=1}^{n}(1-p^*)p_m^{\alpha}(N') + p^*p_s^{\alpha}(N')$$

where:

p (N') denotes the probability density of the refractivity gradient N';

m denotes the daytime (mixed) regime;

s denotes the nighttime (stratified) regime;

$\alpha$ denotes one of n subdivisions of a year;

$$p_m^{\alpha}(N') = (2\pi\sigma_m^2)^{-\frac{1}{2}}\exp\left[-\frac{1}{2}\left(\frac{N'-\mu}{\sigma_m}\right)^2\right]$$

$$p_s^{\alpha}(N') = (2\pi\sigma_s^2)^{-\frac{1}{2}}\exp\left[-\frac{1}{2}\left(\frac{N'-\mu}{\sigma_s}\right)^2\right]$$

wherein:

$N' \geqq \mu$ $\sigma_m$=empirically determined standard deviation $\mu$=for each subdivision of a year $\alpha$, the average refractivity gradient in the lowest kilometer of the atmosphere in said vicinity;

$\sigma_s$=for each subdivision of a year $\alpha$, the larger of $\sigma_{sC}$ and $\sigma_{sI}$, wherein $\sigma_{sC}=\sigma_o(f_iH)^{\frac{1}{2}}(Df_wVM_C)^{\frac{1}{4}}$ $\sigma_{sI}=\sigma_o(f_iH)^{\frac{1}{2}}(aVM_I)^{\frac{1}{4}}$ where $\sigma_o$=empirically determined coefficient for a given height increment of meteorological measurements;

$f_i$=temperature inversion occurrence frequency;

H=air homogeneity=$H_1$ $H_2$ $H_3$, as determined from classes of land surface forms;

D=water distance function=$[1+(d/do)^4]^{-1}$ where $d_o$=maximum distance that air penetrates inland in a period of one day from an ocean, gulf, or one of the Great Lakes, and d is the minimum distance to an ocean, gulf, or one of the Great Lakes;

$f_w$=wind direction occurrence frequency;

V=air moisture capacity;

M=surface moisture availability;

a=empirically determined coefficient.

3. The facility of claim 2 further characterized in that $p^*=0.2$, $n=4$, $\sigma_m=15$, $\sigma_o=540$, $d_o=300$ km, and $a=4.7\times10^{-5}$.

4. The facility of claims 1, 2, or 3 further characterized in that the fade level utilized in choosing said heights of said antennas according to said path profile procedure is calculated relative to the free space level as:

$$R=-10+20\,E/F_1$$

wherein

R is the fade level in decibels;

E is the distance from the top of the controlling obstruction to the virtual ray, and $F_{1r}$ is the radius of the first Fresnel zone at the controlling obstruction, measured in the same units as E, wherein said controlling obstruction is defined as the obstruction for which the dimensionless clearance $E/F_{1r}$ has the greatest negative value.

5. The facility of claims 1, 2, or 3 further characterized in that the minimum distance to an ocean, gulf, or one of the Great Lakes from said antennas is less than 300 kilometers.

6. The facility of claims 1, 2, or 3 further characterized in that said facility comprises two or more of said transmission paths, wherein the expected outage time due to obstruction fading as determined from said probability of outage is allocated to each of said paths so that the total expected outage time due to obstruction fading does not exceed a given amount per year.

* * * * *

UNITED STATES PATENT AND TRADEMARK OFFICE

CERTIFICATE OF CORRECTION

PATENT NO. : 4,346,385

DATED : August 24, 1982

INVENTOR(S) : James A. Schiavone and Arvids Vigants

It is certified that error appears in the above—identified patent and that said Letters Patent is hereby corrected as shown below:

Column 4, line 68, "occurs" should read --occur--. Column 10, line 51, "$R=-10+20E/E_{1r}$" should read --$R=-10+20E/F_{1r}$--. Column 11, lines 66 through 68, "that will most likely cause flow of marine air over continental air adjacent to the coastline is the direction" should be deleted.

Signed and Sealed this

*Twenty-third* Day of *November 1982*

[SEAL]

*Attest:*

GERALD J. MOSSINGHOFF

*Attesting Officer* *Commissioner of Patents and Trademarks*